US007216787B2

(12) United States Patent
Delamare

(10) Patent No.: US 7,216,787 B2
(45) Date of Patent: May 15, 2007

(54) DEVICE FOR FITTING A SUPPORT STOCKING ON A PERSON AND FOR TAKING OFF THE SAME

(76) Inventor: Michel Delamare, 62 rue de Mondoux, Saint-Cyr-sur-Loire (FR) F-37540

( * ) Notice: Subject to any disclaimer, the term of this patent is extended or adjusted under 35 U.S.C. 154(b) by 55 days.

(21) Appl. No.: 11/138,668

(22) Filed: May 27, 2005

(65) Prior Publication Data

US 2006/0076372 A1 Apr. 13, 2006

Related U.S. Application Data

(63) Continuation-in-part of application No. 10/509,014, filed on Sep. 27, 2004, now abandoned.

(51) Int. Cl.
*A47G 25/90* (2006.01)

(52) U.S. Cl. ..... 223/111

(58) Field of Classification Search ..... 223/111, 223/112, 119, 118

See application file for complete search history.

(56) References Cited

U.S. PATENT DOCUMENTS 1,315,096 A * 9/1919 Deiley ..... 223/111
3,310,209 A * 3/1967 Clauss ..... 223/111
3,853,252 A 12/1974 Scianimanico
4,942,988 A * 7/1990 Doorenbos ..... 223/111
5,249,720 A * 10/1993 White ..... 223/112
5,513,783 A * 5/1996 White ..... 223/112
5,924,610 A * 7/1999 Willemin ..... 223/112
6,763,982 B1 * 7/2004 Livornese ..... 223/118

FOREIGN PATENT DOCUMENTS

DE 39 14 824 11/1990

* cited by examiner

*Primary Examiner*—Danny Worrell
(74) *Attorney, Agent, or Firm*—Millen, White, Zelano & Branigan, P.C.

(57) ABSTRACT

The invention relates to a device for fitting an extendible support stocking on a person, optionally oneself, comprising a fixed part supporting a first upper plate (1) having a first upper tongue (2) secured thereto, a movable part slidably mounted on a guide system of said fixed part and supporting a second lower plate (3) having a second lower tongue (4) secured thereto, lever means to move said movable part with respect to said fixed part by making it slide along said guide system from an initial position wherein said first tongue (2) and said second tongue (4) are close to each other and thereby cooperate to form a sleeve that can be fitted inside said stocking, to an operating position wherein said first tongue (2) and said second tongue (4) are progressively moved apart from each other thereby extending said stocking fitted onto said sleeve, then to a releasing position wherein said lower plate (3) is removed separate from said upper plate (1).

40 Claims, 10 Drawing Sheets

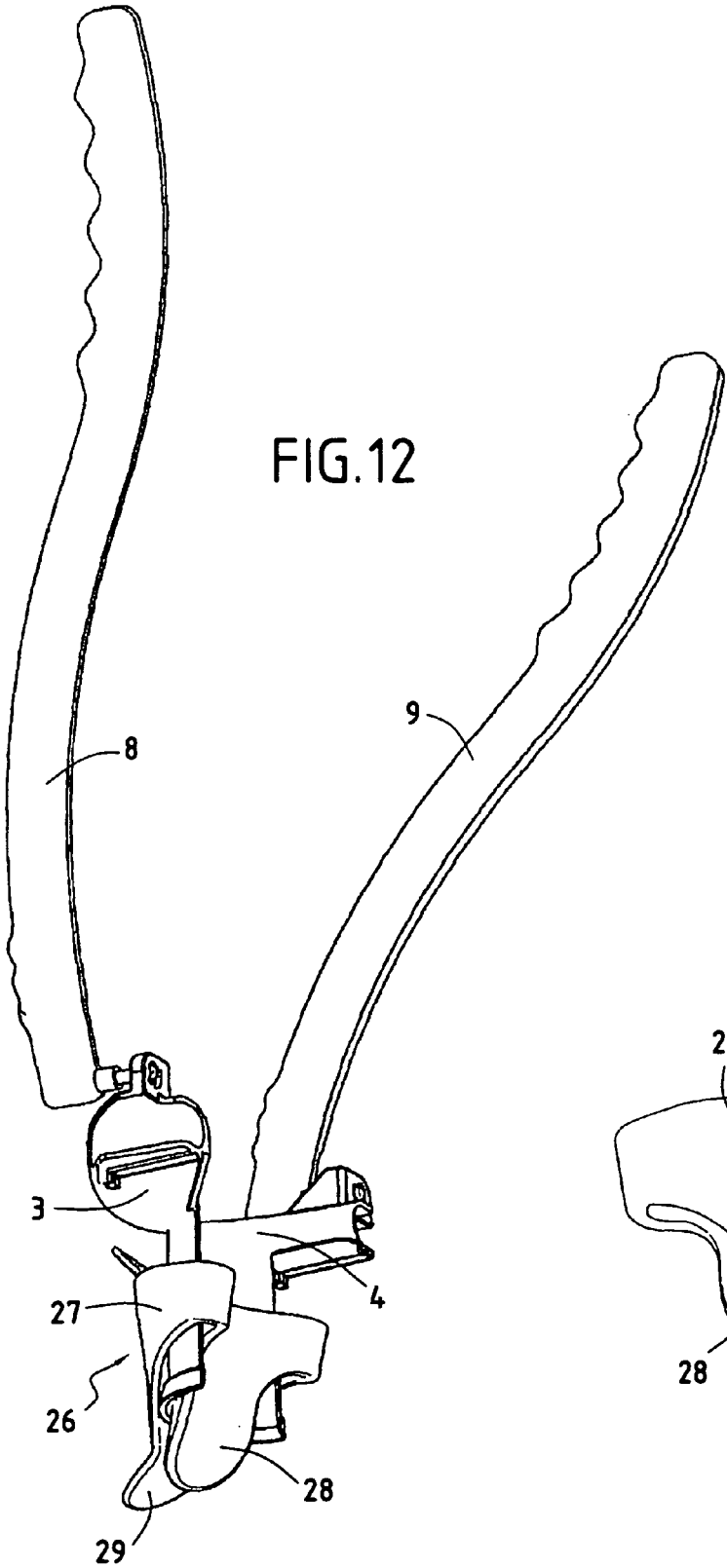
FIG.12
FIG.11
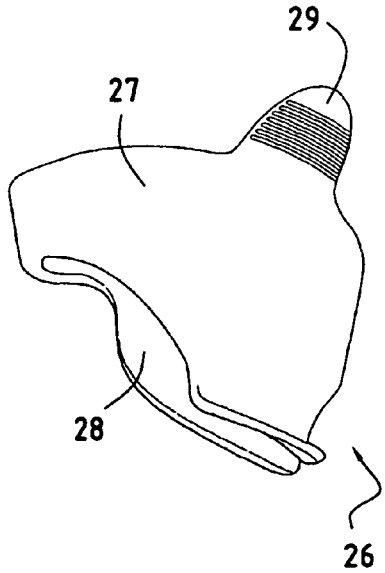

DEVICE FOR FITTING A SUPPORT STOCKING ON A PERSON AND FOR TAKING OFF THE SAME

This application is a continuation-in-part of prior U.S. patent application Ser. No. 10/509,014, filed Sep. 27, 2004 now abandoned, the entire contents of which are incorporated herein, at least by reference if need be.

BACKGROUND OF THE INVENTION

The present invention relates to a device for fitting an extendible elastic support stocking (or sock) on the leg of a person, either by the user himself or with the aid of a third party, as well as to a method for fitting such a stocking or sock on a person by means of said device.

The present invention also relates to a device for taking off a support stocking or sock worn on the leg of a person, and to a method for doing so by means of said device.

Support stockings (The word is intended here to mean socks as well, depending on the height of textile covering the leg) are compressive orthoses that are currently used by persons suffering from venous disorders to achieve venous compression of the affected leg. Venous compression, a unanimously recognized technique for preventing and curing venous disorder, is effective only by virtue of the controlled high pressure exerted by the elastic fibers of the stocking on the limb.

A method currently used for fitting the stocking on consists in holding the support stocking at its top in order to slip the leg therein. However, the high tension exerted by the elastic fibers of the stocking makes it exceedingly difficult to extend the stocking in order to put it on. This is especially difficult when it has to be done by people with reduced mobility who are unable to overcome the resistance of the textile with their hands in order to "pass the heel", and who have furthermore difficulties bending forward, which is indeed frequently the case.

A means currently used for fitting a support stocking on a person consists in a "substocking" made of a silk textile, which plays the role of a liner in the stocking proper and makes it easier to slip the leg into the support stocking.

However, such a means does not solve the technical problems linked with the considerable resistance of the elastic textile and with the mobility difficulties of the users.

The same problem is encountered for the removal of a support stocking worn on the leg of a person: this operation is extremely dificult to carry on by the wearer himself, and especially so when the wearer additionnally suffers from reduced mobility.

It is therefore an object of the present invention to provide a device for facilitating fitting a support stocking on a person's leg.

It is another object of the invention to provide a device that allows to sufficiently distend the compressive stocking (or sock) to allow easy fitting and the "passing of the heel".

It is a further object of the invention to provide a device that allows an easy putting on of the stocking by the user alone.

It is a further object of the invention to provide a device that is easy to disengage from around the leg once the support stocking has been fitted thereon.

It is still another object of the invention to provide a device for facilitating taking off a support stocking worn on the leg of a person, and more particularly for facilitating the passing of the heel.

It is another object of the invention to provide a device for taking off a support stocking that allows an easy removal by the wearer himself.

SUMMARY OF THE INVENTION

The present invention relates to a device for fitting an extendible support stocking on a person, optionally oneself. This device comprises a fixed part supporting a first upper plate having a first upper tongue secured thereto, a movable part slidably mounted on a guide system of the fixed part and supporting a second lower plate having a second lower tongue secured thereto, lever means to move the movable part with respect to the fixed part by making it slide along the guide system from an initial position wherein the first tongue and the second tongue are close to each other and thereby cooperate to form a sleeve that can be fitted inside said stocking, to an operating position wherein the first tongue and the second tongue are progressively moved apart from each other thereby extending the stocking fitted onto the sleeve, then to a releasing position wherein the lower plate is removed separate from the upper plate.

In a prefered embodiment the device comprises lateral handles, which may be removable, for use for putting the stocking on oneself.

The present invention therefore describes a technical solution, on the one hand to sufficiently distending the compressive stocking (or sock) to allow easy fitting and the "passing of the heel", and, on the other hand, by virtue of the addition of elongate handles, to putting on the stocking by the user alone, who will be able to place the device, and therefore the stocking, at the end of his foot without effort.

Furthermore, this device may be used by a third party (for example a nurse applying a stocking to a patient) by removing the detachable handles.

The invention also relates to a device for taking off a support stocking worn on the leg of a person. This device comprises an auxiliary element comprising a front tongue of a hemicylindrical form secured to a back strip, the space formed between the strip and the back face of the tongue being larger at the top than at the bottom of said auxiliary element, and a pushing element comprising a pushing tongue of a hemicylindrical form bearing long handles on its upper part and having a bottom part to be introduced in the space formed in the auxiliary element between the front tongue and the back strip, thereby pinching the stocking between the front tongue and the pushing tongue while pushing the auxiliary elemen tdownwards by means of the handles.

The pushing element of the device, by virtue of its elongate handles, will allow the user to remove his support stocking by himself.

The device for taking off a support stocking worn on a person according to the invention preferably comprises the movable part of the device for fitting a support stocking on a person.

BRIEF DESCRIPTION OF THE DRAWINGS

The description herein makes reference to the accompanying drawings in which:

FIG. 11 represents a general view of an auxiliary element for taking off a support stocking FIG. 12 shows a general view of a device for taking off a support stocking according to a prefered embodiment of the invention.

DETAILED DESCRIPTION OF THE INVENTION

Figure 1:
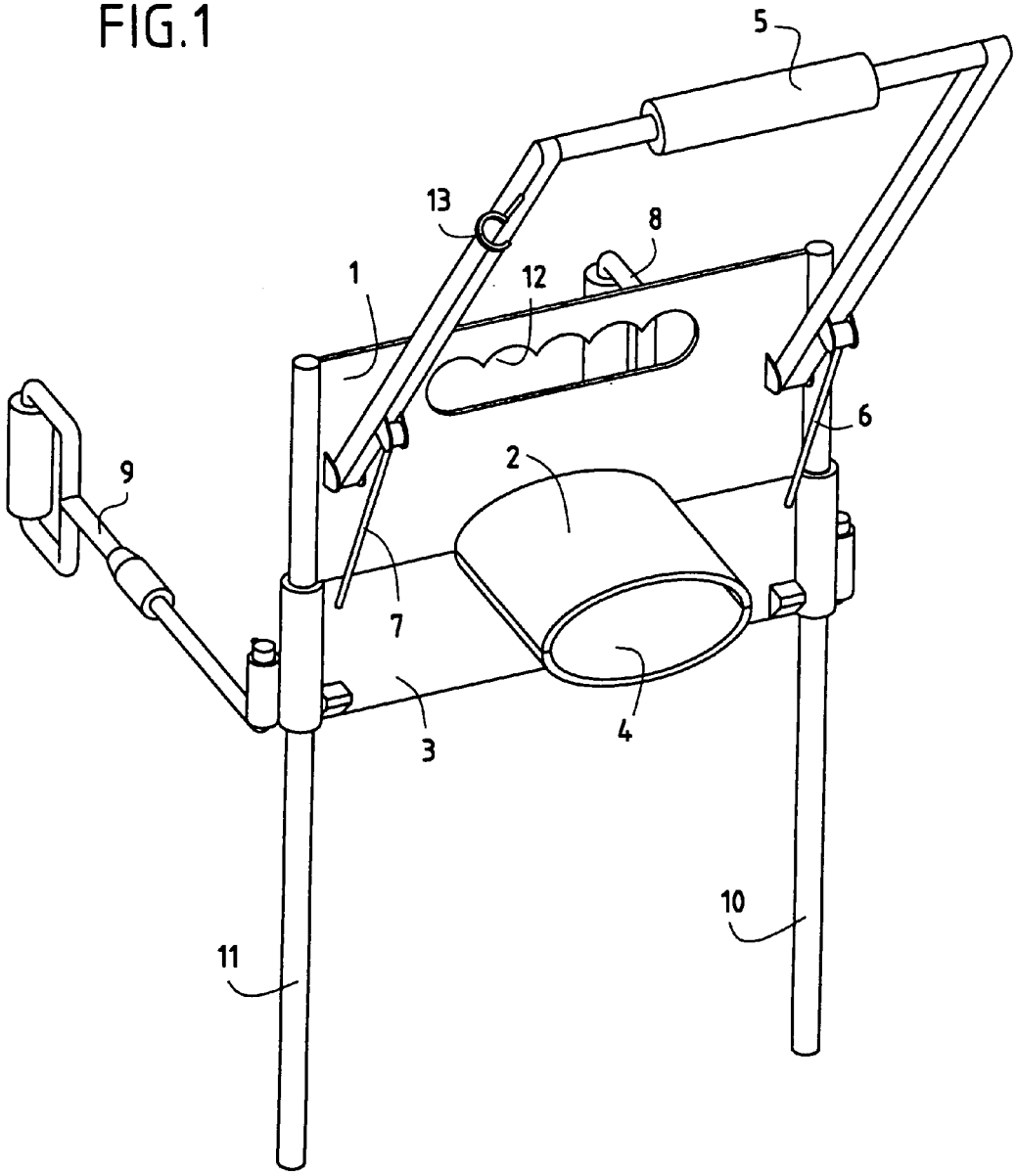
FIG. 1 represents a device for fitting a support stocking on a person according to a prefered embodiment of the invention, seen in a front three-quarters view in the closed position.

The device for fitting an extendible support stocking on a person comprises a-fixed part supporting a first upper plate having a first upper tongue secured thereto, a movable part slidably mounted on a guide system of the fixed part and supporting a second lower plate having a second lower tongue secured thereto, and lever means for moving the movable part with respect to the fixed part by making it slide along the guide system.

When brought close to each other, the upper tongue and the lower tongue form a sleeve onto which the stocking to be fittted on can be slid. Then, by way of the lever means, the movable lower plate can be easily moved apart from the fixed upper plate, which leads to the parting of the lower tongue from the upper tongue and to the subsequent extension of the stocking by distending the elastic material it is made of.

The extension is maximal when the device reaches the releasing position, wherein the lower plate may be removed separate from the upper plate, but the lower tongue is held joint to the upper tongue by the stocking fitted on the enlarged sleeve formed by both tongues. Such an extension allows the passage of the foot, including the heel, inside the stocking, then that of the person's leg.

Once the stocking has been fitted on the leg, by pulling the device positioned in front of the foot towards the person, so as to insert the foot and the heel inside the stocking then to unroll the stocking around the leg, the lower plate, which is not held joint to the upper plate by the stocking any longer, is removed separate from the upper plate. The device is then separated into two distinct parts, and it can be easily disengaged from around the leg.

In a prefered embodiment, the guide system comprises two parallel slide guides which are interconnected at one end by the first plate supporting the first upper tongue and which are free at the other end, allowing translational movement of the second lower plate with respect to the first upper plate. The movable part can then be uncoupled from the rest of the device by sliding it down out of the free ends of the slide guides. The slide guides are preferably 20 to 35 cm long, and they are separated from one another by at least 20 cm.

Preferably the lever means are hollow and they can be lowered to a position where they come over said slide guides. In a prefered embodiment the lever means and the slide guides are beveled at their respective free ends which get inserted into one another, so as to avoid any risk of the user's fingers being pinched between them.

The device preferably comprises lateral handles for use for putting said stocking on oneself, which are fixed on each side of the movable part, and which are preferably removable.

These handles have preferably a variable length. In a prefered embodiment, this is achieved by providing an extension piece for each of the handles secured to the device, each said piece being removably affixed to the latter when needed.

In a prefered embodiment, the handles are 60 cm long, they have an ergonomic form, and their outer surface bears a series of notches facilitating their handling. Such handles are particularly useful in that they facilitate the fitting on of the sock or stocking on oneself, by allowing to present the device in front of one's foot without having to bend on oneself exaggerately, and to pull it towards oneself without high efforts.

According to an advantageous feature of the invention, the handles are fixed to the movable part with an adjustable inclination, between a resting position where they are both in the same plane as the second lower plate, and different operating positions, where the angle between them is between 0 and 90 degrees, preferably around 40 degrees. The inclination of the handles can be adjusted according to the wishes and particularities of the user.

In a prefered embodiment, the first upper tongue and the second lower tongue show a curved section, the upper tongue having a larger radius of curvature and thereby being more flattened than the lower tongue, while the latter has a smaller radius of curvature and is downwardly more concave to allow the passage of the heel. The upper tongue and the lower tongue form a rectilinear ovoid sleeve, when brought close together by sliding the lower plate towards the upper plate along the guide system.

The lever means preferably comprise a lever fastened on the fixed part on each side of the device, which is operative to push the movable part away from the fixed part by way of two connecting rods bearing on blocking members on the movable part. This feature reduces the effort required to move the lower plate against the elastic reaction of the stocking which is engaged onto the sleeve, in the position wherein the tongues are distant from each other and the stocking is thereby in an extended conformation.

In a prefered embodiment the lever means bear two handles for their manipulation, which are fixed on each side of the device. The invention advantageously provides that these handles be hollow and fit around the slide guides when the lever means are lowered in order to extend the stocking fitted over the sleeve.

The lever means preferably bear an abutment that prevents them from being raised above an angle of 60 degrees with respect to the guide system.

In a prefered embodiment the movable part is mounted on the guide system through two sleeves slidably mounted respectively on two slide guides of the guide system, with each presenting three blocks or blocking members in alignment with the corresponding slide guide, onto which the connecting rods successively bear during the operation of the device. Each of the slide guides comprises three distinct partitions associated each with one of the blocking members, for receiving a pin which is rotatably fixed on one end to the corresponding sleeve, and which is free on the other end to fall into one of the partitions, blocking the movable part in its corresponding position on the slide guides, when the connecting rods push on the corresponding blocking members.

The extension of the stocking fitted onto the sleeve is thereby performed in three successive steps, by pushing by means of the connecting rods successively on each of the blocking members. This results in a displacement of the pins moving them successively from one partition to another, until complete extension of the stocking is achieved. The pins are blocked in the partitions by the elastic strength of the stocking which tends to bring the first and second tongues toward each other, thereby jamming the pin against the wall of the partition. The device remains in this position until the connecting rods push on the next blocking members, thereby releasing the pins from the partitions, and moving them to the next ones. Thus is advantageously performed, in three steps, a large extension of the stocking.

In a prefered embodiment of the invention in accordance with the above, the upper tongue and the lower tongue can be moved apart from each other by a distance of up to 18 cm, so as to allow an easy passage of the heel in between, without the risk of tearing the stocking.

The partitions preferably have a slanting bottom for receiving the pins, which favours the blocking of the pins in the partitions, while ensuring a good solidity of the device.

In a prefered embodiment the device comprises means for strongly blocking the pins in the partitions which are the farthest away from the fixed part. Preferably, the free ends of the pins are made of a metallic material and a magnet is fixed in the bottom of the partitions which are the farthest away from the fixed part, so that the pins are blocked in these partitions, in a position where the stocking is fully extended.

The connecting rods and the blocking members preferably have cooperating forms, so as to facilitate the pushing of the movable part by the connecting rods.

In a prefered embodiment, the lever means bear a hook which fastens onto a cooperating bar on the fixed part for locking the device in a completely open position in which the first upper tongue and the second lower tongue are far enough from each other to allow the passage of the heel in between, and in which the upper plate and the lower plate are still connected together through the guide system.

Once the stocking has been sufficiently extended, the device is thus blocked in the open position, and it remains in this position until the user decides to fit the stocking on. This also eliminates the risk that the device come back to the initial position, wherein the stocking is not extended, during its handling by the user when positioning it in front of the foot and pulling it towards the wearer in order to fit the stocking on.

In another prefered embodiment it is the magnet fixed in the bottom of the partitions which ensures the blocking of the device in a position where the stocking is fully extended, while the upper plate and the lower plate are still connected together through the guide system.

According to the invention, the upper tongue and the lower tongue are shaped so as to ensure that the stocking will not slip from the sleeve they form together. In a prefered embodiment, they both widen upwards in all planes, preferably by 2 to 3 degrees with respect to their longitudinal axes.

According to an advantageous feature of the invention, the upper tongue and the lower tongue bear each a thicker collar at their upper edge, so that the stocking fitted onto the sleeve cannot slip from this position. This collar preferably presents an upwardly inclined outer side face, which is preferably inclined by 5 to 15 degrees, and more preferably by 10 degrees, with respect to the longitudinal axes of the tongues. Such an inclination advantageously ensures on the one hand that the stocking will not slip from the sleeve during the extension movement, and on the other hand that it will be released from the sleeve at the right time in order to be fitted on the leg of the user. In a prefered embodiment, the collar has a planar lower face and round wedges, thereby avoiding that any damage is caused to the stocking.

The device preferably comprises wedges for supporting it when resting on a support surface.

In a prefered embodiment the device for fitting a support stocking on a person according to the invention comprises an upper fixed part comprising a first upper plate having a first upper tongue fastened thereon, and a lower movable part which is slidably mounted on a guide system and comprising a second lower plate having a second lower tongue fastened thereon, the first tongue and the second tongue forming a sleeve for the stocking to be fitted onto when brought close to each other, and a lever for separating the first tongue and the second tongue from each other by sliding on the guide system after the stocking has been introduced by being slid onto the sleeve, so as to enlarge the stocking by distending the material it is made of to allow the passage of the heel and the leg of the person, which comprises detachable lateral handles, and wherein the lower movable part of the device can be removed separate from the rest of the device.

A method for fitting an extendible support stocking on a person by means of the device according to the invention comprises fitting the stocking onto the sleeve formed by the first upper tongue and the second lower tongue brought close to each other, then moving the lower plate apart from the upper plate by way of the lever means, thereby extending said stocking by distending it, positioning the device in front of the person's foot, and pulling the device towards the person so as to pass the person's foot and leg inside the stocking and thereby fit the stocking on.

The lower movable part of the device, comprising the second lower plate and the second lower tongue, and lateral handles fixed on each side of the movable part, may also be used for taking off the support stocking worn on a person's leg, by pushing an upper part of the stocking toward the person's foot by means of the second lower tongue slipped into the top of the stocking, and passing the stocking over the person's heel.

The invention also relates to a device for taking off a support stocking worn on a leg of a person.

This device comprises an auxiliary element comprising a front tongue of a hemicylindrical form secured to a back strip, the space formed between the strip and the back face of the tongue being larger at the top than at the bottom of said auxiliary element, and a pushing element comprising a pushing tongue of a hemicylindrical form bearing long handles on its upper part, and having a bottom part to be introduced in the space formed in the auxiliary element between the front tongue and the back strip, for thereby pushing the stocking pinched between the front tongue and the pushing tongue downwards by means of the handles In a prefered embodiment, the pushing element comprises the movable part of the device for fitting a support stocking on a person according to the invention, comprising the second lower plate, the second lower tongue and the lateral handles.

According to an advantageous feature of the invention, the front tongue and the pushing tongue have complementary forms, so that the front tongue and the pushing tongue can be applied perfectly against one another, and thereby pinch strongly the stocking in between.

In a prefered embodiment, the width of the space between the front tongue and the back strip decrases from a value larger, to a value smaller, than the thickness of the bottom part of the pushing tongue, so that the stocking inserted between the front tongue and the back strip can be pinched strongly between the front tongue and the pushing tongue inserted in the auxiliary element. Preferably, the bottom part of the pushing tongue is between 8 to 10 mm thick, and the width of the space between the front tongue and the back strip decrases from a value larger than 20 mm at the top of the auxiliary element, to a value between 6 to 8 mm at the bottom.

In a prefered embodiment, the auxiliary element bears on its upper part, extending upwards from the back strip, a small tongue for its gripping. This small tongue is preferably straight and long enough to abut against a complementary part on the pushing element when the pushing tongue is almost completely inserted between the front tongue and the back strip, avoiding thereby that the pushing tongue penetrates between the front tongue and the back strip so far that it pushes the stocking outside the auxiliary element.

In such an embodiment, the invention advantageously provides that the pushing element comprises the movable part of the device for fitting a support stocking on a person according to the invention, comprising the second lower plate and the second lower tongue, and that the complementary part of the small tongue is the second lower plate.

The invention also relates to a method for taking off a support stocking worn on a leg of a person, which comprises applying between the leg and the stocking an auxiliary element comprising a front tongue of a hemicylindrical form secured to a back strip, the space formed between the strip and the back face of the tongue being larger at the top than at the bottom of the element, in such a way that the stocking is inserted between the front tongue and the back strip, then introducing a pushing element comprising a pushing tongue of a hemicylindrical form bearing long handles on its upper part, by making a bottom part of this pushing tongue penetrate in the space formed in the auxiliary element between the front tongue and the back strip, so as to pinch the stocking between the pushing tongue and the front tongue, and pushing downwards by means of the handles the stocking pinched between the front tongue and the pushing tongue.

DETAILED DESCRIPTION OF THE DRAWINGS

The description of the apparatus given below makes it necessary to state details regarding dimensions, which may be subject to modifications depending on the size of the apparatus (for a large adult, a normal adult or a child) and on technical improvements. The dimensions are given by way of example.

Figure 2:
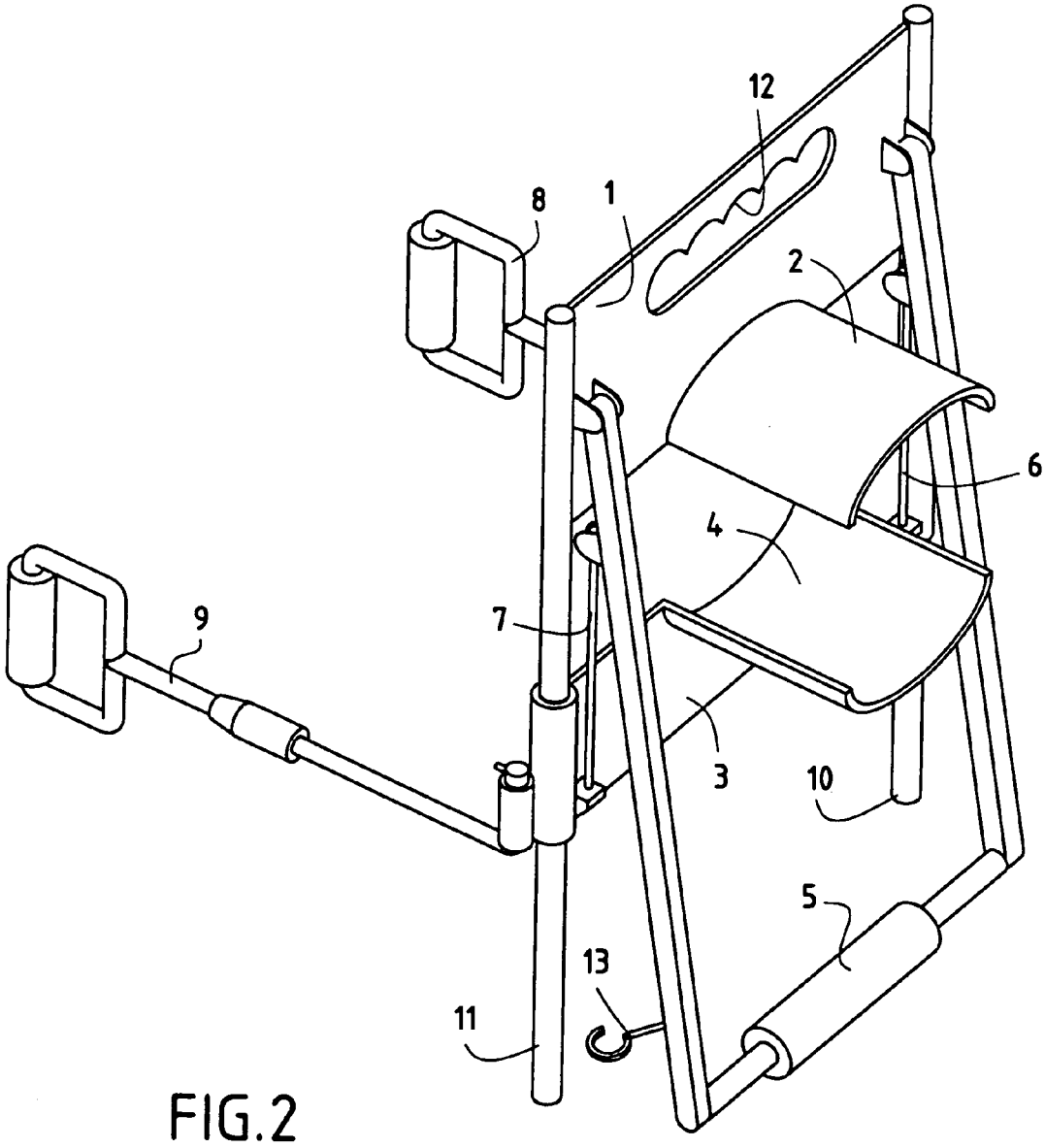
FIG. 2 shows the device illustrated in FIG. 1 seen in a front three-quarters view in the open position.

In a prefered embodiment of the invention, which is illustrated in FIGS. 1 and 2, the apparatus, manufactured in metal or plastic, is composed of a flat plate 1 which is 28 cm long by 4.5 cm wide, securing two rods 10 and 11 of 20 mm diameter which are welded at its ends and which act as a slide guide, and supporting a rectangular tongue 2 which is 9 cm wide by 10 cm long in the form of an upwardly convex, flattened semicylinder perpendicular to said plate, constituting the upper part of the system for opening the stocking (or the support sock). Underneath, a flat plate 3 having a height of 8.5 cm, fastened to two tubes which slide on the slide guides 10 and 11, supports a tongue 4 which is 9 cm wide by 10 cm long in the form of a downwardly very concave, small-radius cylinder portion, that constitutes the lower part of the sock-opening system.

The stocking is introduced by being slid over the ovoid tube formed by the two tongues 2 and 4. By means of a lever 5 fastened to the top plate 1 and by way of 15-cm-long connecting rods 6 and 7 fastened onto the lever 5 at a distance of 5.5 cm from its hinge pins, the user will exert a relatively small downward force after taking hold by his other hand of the handle 12 provided at the top of the apparatus and made in the fixed plate 1. The action of the lever will make it possible to separate the two plates 1 and 3 by moving away the sliding plate 3 and therefore to separate the two tongues 2 and 4 in order to distend the stocking. The apparatus will thus be able to remain "locked" in the open position by virtue, on the one hand, of the alignment of the connecting rods with the lever and, on the other hand, of a small hook 13 which will hook onto the slide rods.

The opening thus formed between the two tongues, which opening is 14 cm high by 9 cm wide, makes it possible to enlarge the support stocking by distension and to keep it open and to ensure the passage of the foot, which will push, at the bottom of the tubular part formed by the two tongues 2 and 4, against the sock blocking the end. The passing of the heel, which was one of the technical difficulties, will be accomplished with very great ease (which would make it possible, for example, to fit support stockings in a gentle manner, and without causing any pain, to bedridden patients after they have been chirurgically operated on).

The detachable elongate handles 8 and 9, which are fastened on each side of the apparatus and can be adjusted in length for greater ergonomics, allow a seated user to place the apparatus at the end of his foot without needing to bend forward, thus being advantageous for elderly people, and to perfectly control the maneuver with one hand on each side of the leg. The handles make it possible to keep the apparatus at a distance and vertical, if necessary placed on the ground and resting on the two slide rods 10 and 11, so that the tip of the foot can be easily inserted between the two tongues 2 and 4. While extending his leg, the user will pull the apparatus toward him, thereby allowing the sock (or the stocking) to slip over, become free of the tongues and be applied to the foot and the leg. By virtue of its moving lower plate 3, the apparatus will allow easy passage of the knee and may be raised as far as the thigh (in the case of a thigh stocking).

Figure 3:
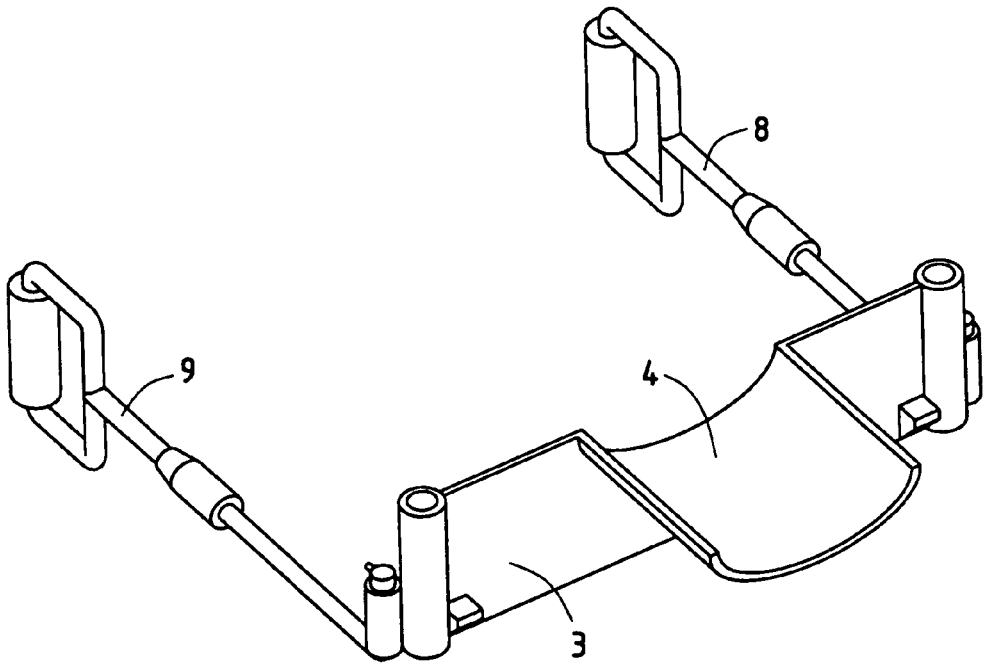
FIG. 3 shows the movable part of the device illustrated in FIG. 1 usable for taking off the support stockings.
Figure 4:
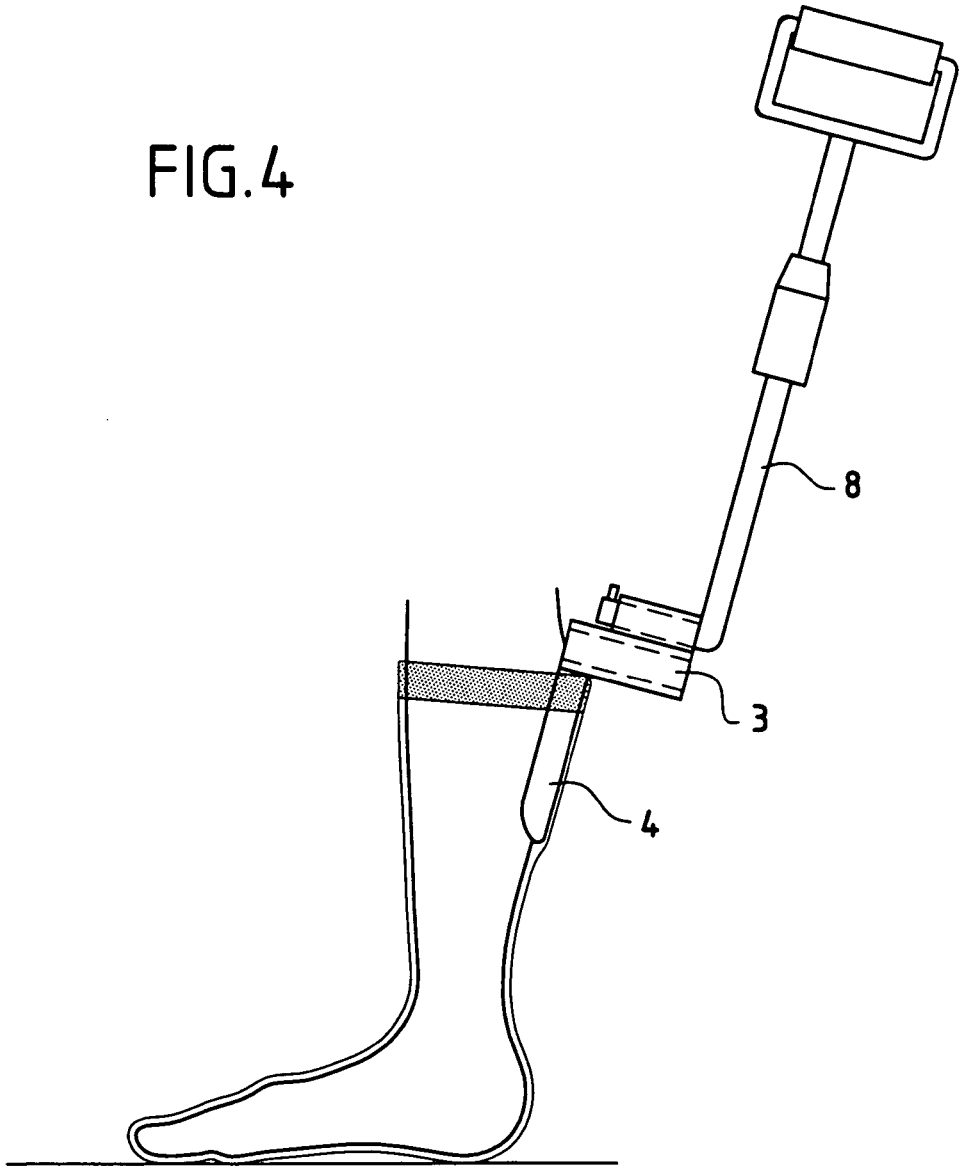
FIG. 4 is a schematic representation of the first step of a method for taking off a support stocking by means of the movable part illustrated in FIG. 3.
Figure 5:
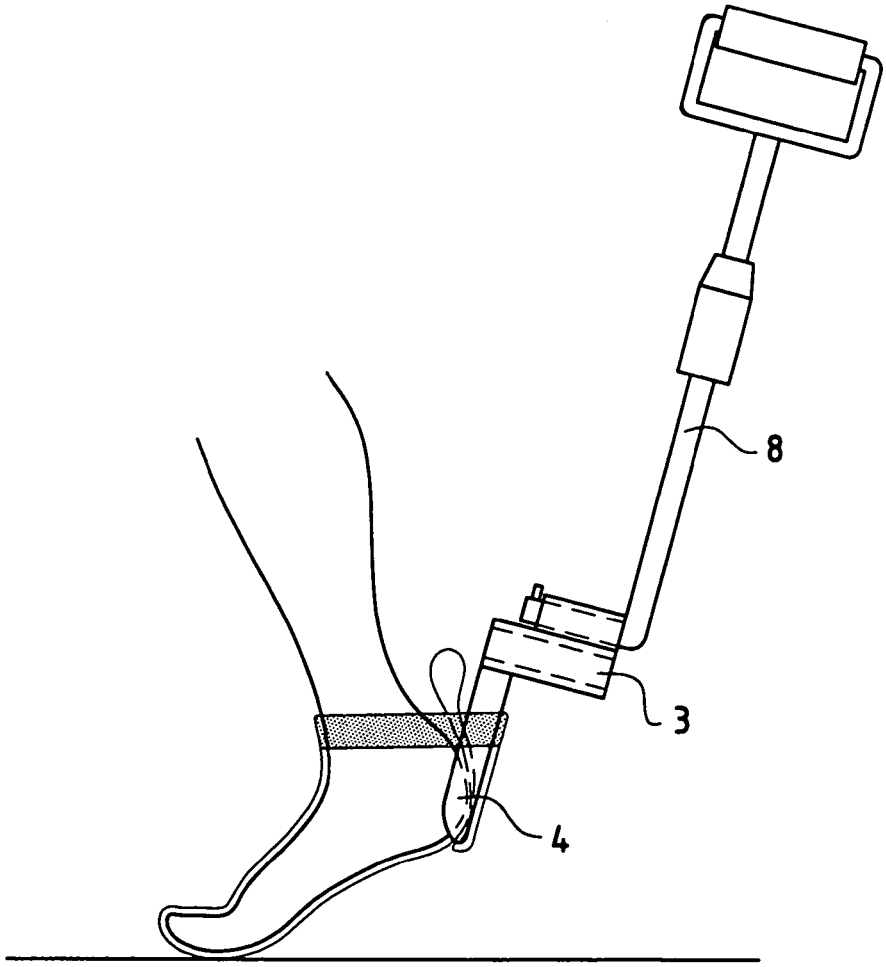
FIG. 5 is a schematic representation of a further step of the method for taking off a support stocking illustrated in FIG. 4.
Figure 6:
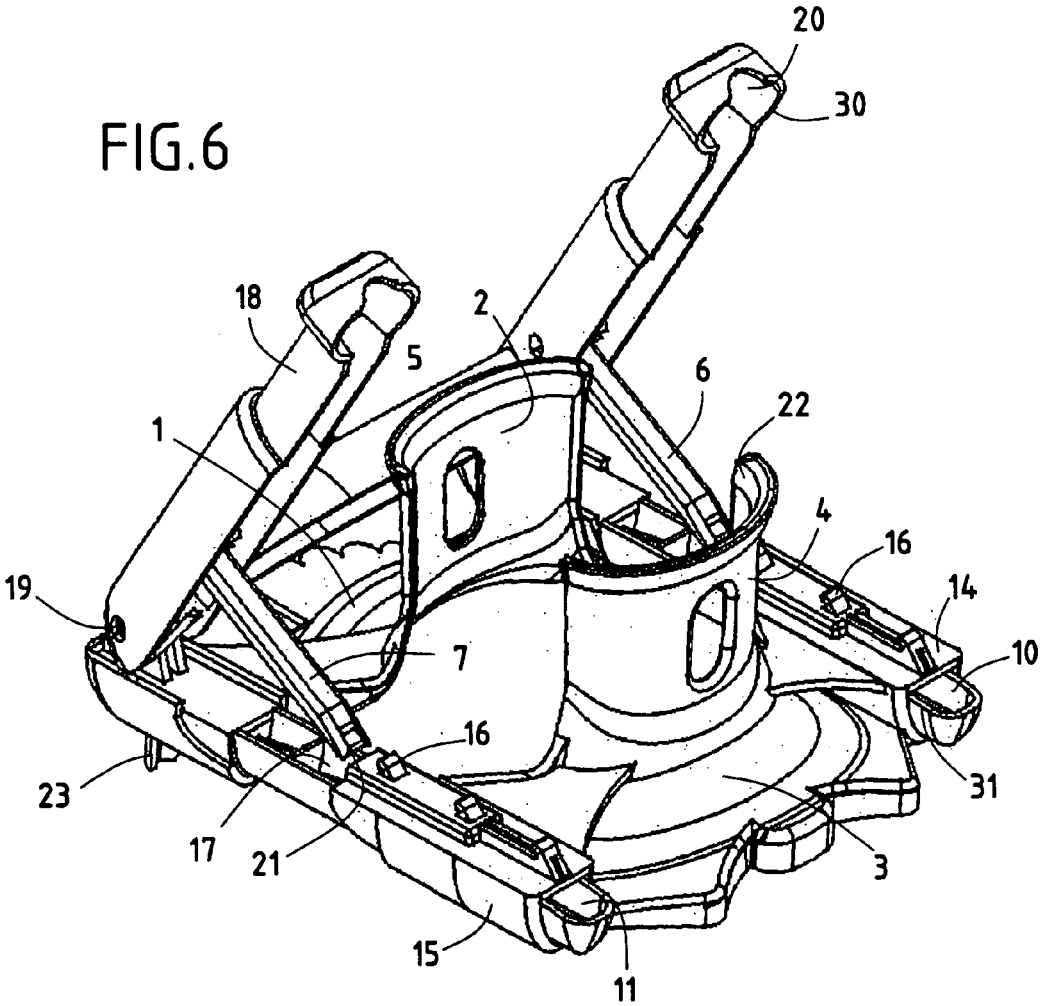
FIG. 6 represents a general view of a device for fitting a support stocking on a person according to another prefered embodiment of the invention, in an intermediate open position

The operation of taking off the support stocking is carried out simply with the aid of the moving part of the apparatus, which is shown in FIG. 3, that is to say the bottom plate 3 which is flanked by the two elongate handles 8 and 9 and supports, fastened perpendicularly, a tongue 4 which is 10 cm long by 9 cm wide in the form of a downwardly concave, small-radius cylinder portion. The user will slip this tongue between the sock and the calf until the sock comes to rest against the plate 3, as illustrated in FIG. 4. The user will push the apparatus toward the ankle by means of the two lateral handles 8 and 9, which allow accurate guided movement along the axis of the leg. The stocking, held by the tongue 4 at its upper orifice, will be folded over between the tongue and the leg, as illustrated in FIG. 5; in a movement of bending the stocking around the heel made possible by virtue of the hollow shape of the tongue and by virtue of the length of the two handles and of the precision of the action that they allow, and the stocking will be thereby removed from the foot with effortless ease (FIGS. 4 and 5).

It is quite clear that this apparatus may also be used for ordinary socks or stockings (not support ones) where appropriate following some technical modifications.

By way of nonrestrictive example, the lever and the connecting rods could have different dimensions, as could the tongues.

The technical and industrial implementation of the apparatus does not raise any particular problems. The apparatus is composed of five different parts which can be produced by compression molding and injection molding (polymer material for example).

Only two assembly operations have to be performed: these are the assembly of the connecting rods 6 and 7 on the lever 5 by means of a hinge pin, and the assembly of the lever 5 on the fixed plate 1. The other two assemblies (moving part 3 on fixed part 1 and elongate handles 8 and 9 on moving part 3) are linked with the operating mode of the apparatus and are therefore carried out by the user.

Another prefered embodiment of the device of the invention is illustrated on FIGS. 6 to 10.

It comprises the fixed part supporting the first upper plate 1 having the first upper tongue 2 secured thereto, and the movable part supporting the second lower plate 3 having the second lower tongue 4 secured thereto.

The slide system comprises two parallel slide guides 10 and 11, onto which the movable plate 3 is slidably mounted by means of two sleeves 14 and 15 respectively fitted around the slide guides 10 and 11. The slide guides are 30 cm long, and they are separated by a 20 cm distance.

Each of the sleeves 14 and 15 bears on its upper face three blocking members 16 which are aligned with the slide guides, respectively 10 and 11.

Each of the slide guides 10 and 11 presents three partitions 17 arranged along its length, which are open on their upper face and correspond to the three blocking members 16 on each of the sleeves 14 and 15.

The lever means comprise a lever 5 which bear two handles 18 which extend longitudinal, respectively on each side of the device. The handles 18 are hollow. They are hinged on an axis 19 which is perpendicular to the slide guides 10 and 11 in such a way that then can be lowered to a position where they come over the slide guides 10 and 11 and the sleeves 14 and 15. The lever 5 can be raised up to an angle of 60 degrees with respect to the slide guides 10 and 11. It is blocked in this position in its upward motion by abutments arranged at the rear side of the device.

The handles 18 present at their free end an aperture 20 that allows them to fit around and embrace the sleeves 14 and 15 when they are in their lower position.

The handles 18 and the slide guides 10 and 11 are beveled at their respective free ends 30 and 31. They show there cooperating forms.

Each handle 18 of the lever means is secured to a connecting rod 6 and 7, which is rotatably fixed to the handle at one of its ends. At the other end, the connecting rods 6 and 7 are provided with a transversal bar 21, which cooperates with a hook-forming part of each of the blocking members 16, so that they are able to push efficiently the sleeves 14 and 15, and thus the movable part, away from the fixed plate 1.

The first tongue 2 and the second tongue 4 form together a sleeve which can be fitted inside the stocking. They bear each a thicker collar 22 at their upper edge, so that the stocking when engaged over the sleeve cannot slip from this position. The collar 22 presents an upwardly inclined outer side face, which is inclined by 10 degrees with respect to the longitudinal axes of the tongues 2 and 4. It has a planar lower face and round wedges, thereby avoiding that any damage is caused to the stocking.

The device comprises support wedges 23 at its rear side.

Each of the sleeves 14 and 15 is associated with a pin 24 which is rotatably fixed by one end to its inner upper face, facing the partitions 17 of the slide guides 10 and 11. The pins 24 are free at their other end to fall inside the partitions 17 when placed above them.

Each of the pins 24 is made of a metallic material. It is associated with a magnet 25 fixed at the bottom of each of the partitions 17 which are the farthest away from the fixed part, as shown in FIG. 10*b*.

Figure 9:
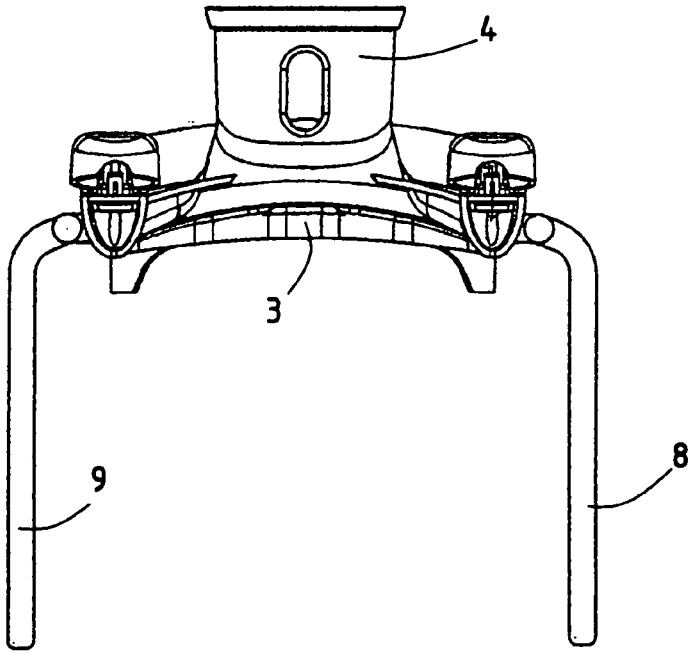
FIG. 9 represents a side view of the device illustrated in FIG. 6 with lateral handles.

The device may comprise lateral handles 8 and 9 for its manipulation, as shown in FIG. 9. These handles are rotatably fixed on each side of the movable plate 3, so that their inclination with respect to the movable plate 3 may be adjusted between different positions.

The operation of the device proceeds as follows.

Figure 7:
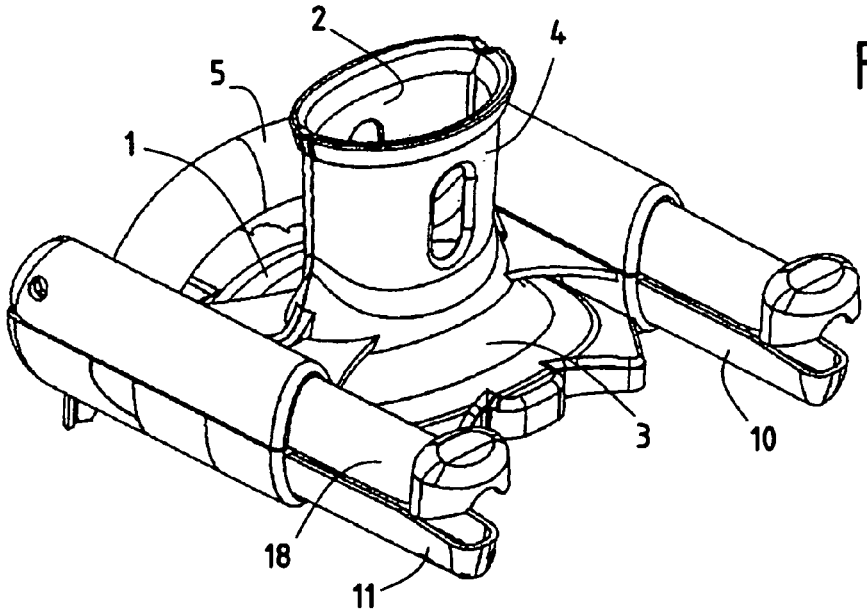
FIG. 7 shows a general view of the device illustrated in FIG. 6 in the closed position.

In the initial position, as illustrated on FIG. 7, the upper tongue 2 and the lower tongue 4 are close to each other, and the lever 5 is in its lower position, the handles 18 covering the guide slides 10 and 11 and the sleeves 14 and 15. The sleeves 14 and 15 are in a rear position, the pins 24 being folded parallel to the slide guides 10 and 11, as illustrated on FIG. 10*a*.

In this position the stocking is fitted over the sleeve formed by the upper tongue 2 and the lower tongue 4.

Figure 10A:
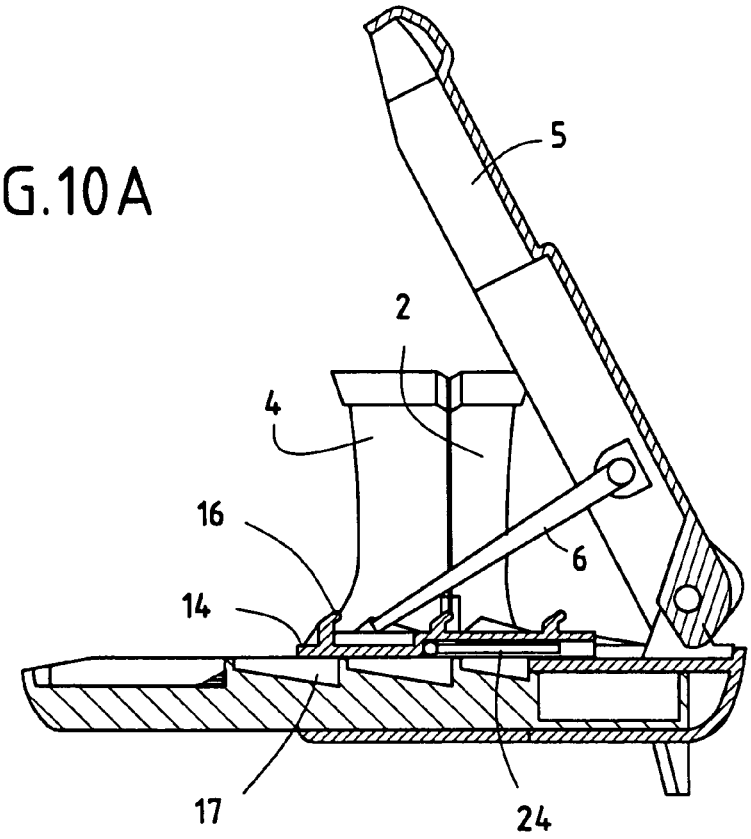
FIG. 10*a* shows a cross-sectional view of the device illustrated in FIG. 6 in the closed position.
Figure 10B:
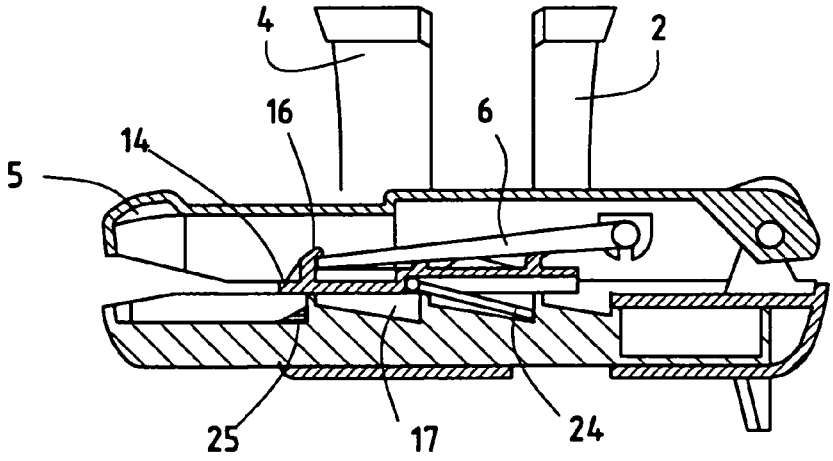
FIG. 10*b* shows a cross-sectional view of the device illustrated in FIG. 6 in an intermediate open position.

Then the lever 5 is raised to its upper position, where it forms an angle of 60 degrees with the fixed plate 1, as shown in FIG. 10*a*. The connecting rods 6 and 7 are placed so as to bear respectively on the farthest block 16 of each of the sleeves 14 and 15.

The lever 5 is then lowered, and the connecting rods 6 and 7 push on the blocking members 16, thereby making the sleeves 14 and 15 slide along the slide guides 10 and 11. When the pins 24 come to a position where their free ends are above the first partitions 17, they fall in these respective partitions. The device is blocked in this position, as illustrated in FIG. 10*b*, by means of the elastic strength of the stocking fitted over the tongues 2 and 4, which tends to bring them closer to one another, thereby blocking the pins 24 against the rear walls of the partitions. The lever 5 is then in its lower position. During that pushing step, the device, which is preferably resting on a plane surface, remains stable owing to the wedges 23. This operation only requires a small effort by the user.

Figure 10C:
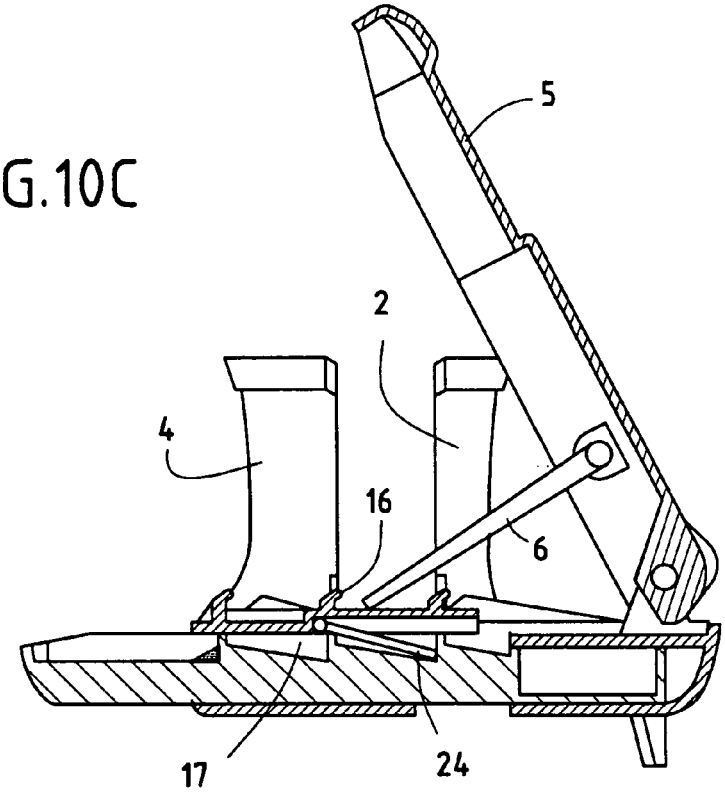
FIG. 10*c* shows a cross-sectional view of the device illustrated in FIG. 6 in a further intermediate open position.
Figure 10D:
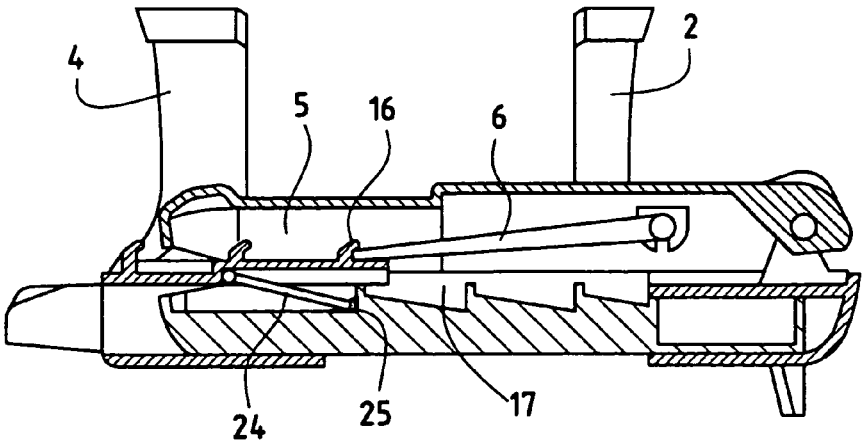
FIG. 10*d* shows a cross-sectional view of the device illustrated in FIG. 6 in the completely open position.

The lever 5 is then raised again, as illustrated on FIG. 10*c*, and the connecting rods 6 and 7 are placed so as to be facing the second serie of blocking members 16. When the lever 5 is lowered again, the connecting rods push on blocking members 16, thereby moving the movable part away form the fixed part. The pins 24 are then disengaged from the partitions 17, and moved towards the next partitions, where they fall and get jammed when the lever 5 is in its lower position.

Figure 8:
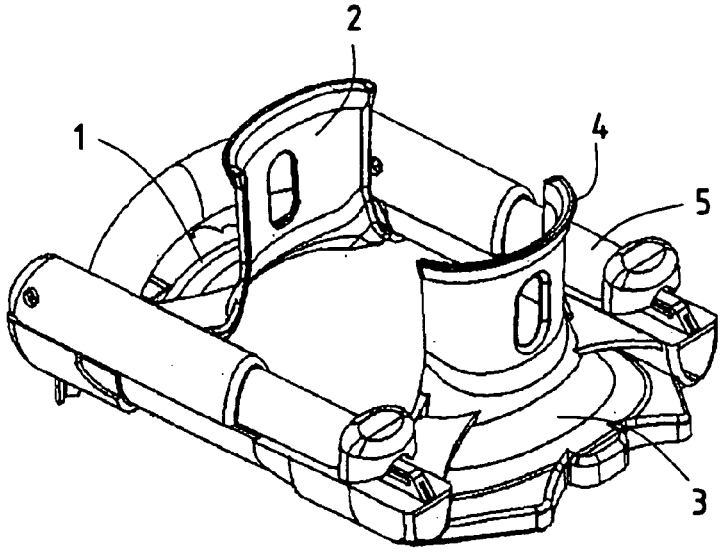
FIG. 8 shows a general view of the device illustrated in FIG. 6 in the completely open position.

This operation is repeated with the last serie of blocking members 16, until the position illustrated on FIGS. 8 and

10*d* is reached, where the first tongue 2 and the lower tongue 4 are far away from each other, the pins 24 being blocked in the last serie of partitions 17, and maintained there by the action of the magnets 25. In this position, the stocking is completely extended and ready to be fitted on the user. The first tongue 2 and second tongue 4 are about 18 cm away from each other.

The stocking can then be fitted on a person in the same way as described above. Once it has been fitted on, the movable part is removed separate from the rest of the device.

The whole operation is easy to carry on, and it allows a large extension of the stocking without needing any strong efforts.

The movable part, once separated from the rest of the device, can also be used as part of a device for taking off a support stocking worn on the leg of a person.

This device of the invention as described herein further comprises an auxiliary element 26 which is shown on FIG. 11.

The auxiliary element 26 comprises a front tongue 27 of a hemicylindrical form, which is secured to a back strip 28.

The space between the back strip 28 and the tongue 27 is larger at the top, than at the bottom of the element.

The auxiliary element 26 bears a small tongue 29 on its upper part, which extends upwards from the back strip 28, and which is useful for gripping the element.

The device for taking off a support stocking also comprises a pushing element which is the movable part 4 of the device for fitting a support stocking, comprising a pushing tongue which is the lower tongue 4, of a hemicylindrical form, and bearing the handles 8 and 9.

The front tongue 27 and the pushing tongue 4 have complementary forms, so that they can be applied against one another.

The width of the space between the front tongue 27 and the back strip 28 decreases from 20 mm at the top of the element, to 6 to 8 mm at its bottom, whereas the pushing tongue 4 is 8 to 10 mm thick.

The small tongue 29 of the auxiliary element is straigth, and it is long enough to abut against the lower plate 3 when the pushing tongue 4 is almost completely inserted between the front tongue 27 and the back strip 28.

The device for taking off a support stocking worn on a person's leg is operated as illustrated on FIG. 12.

The auxiliary element 26 is applied between the leg and the stocking, the back strip 28 coming into contact with the leg and the stocking being inserted between the front tongue 27 and the back strip 28.

The pushing tongue 4 of the pushing element is then inserted, by its bottom part, in the space formed between the front tongue 27 and the back strip 28, in such a way as to pinch the stocking between the front tongue 27 and the pushing tongue 4.

The dimensions of the elements, and more particularly the thickness of the pushing tongue 4 and the width of the space between the front tongue 27 and the back strip 28, ensures that the stocking is pinched strongly between the two elements.

Because of the presence of the small tongue 29, which abuts against the plate 3, the pushing tongue 4 does not penetrate in the auxiliary element 26 so far as to push the stocking outside the auxiliary element 26.

Once the elements have been put into place, the user pushes the device downwards by means of the handles 8 and 9, so as to push down the stocking pinched between the two elements, and then to pass the heel. The taking off of the stocking is thus easily performed.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosure of all applications, patents and publications, cited herein and of corresponding U.S. Provisional Application Ser. No. 10/509,014, filed Sep. 27, 2004, is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A device for fitting an extendible support stocking on a person comprising a fixed part supporting a first upper plate (1) having a first upper tongue (2) secured thereto, a movable part slidably mounted on a guide system of said fixed part and supporting a second lower plate (3) having a second lower tongue (4) secured thereto, lever means to move said movable part with respect to said fixed part by making said moveable part slide along said guide system, from an initial position wherein said first tongue (2) and said second tongue (4) are close to each other and thereby cooperate to form a sleeve that can be fitted inside said stocking, to an operating position wherein said first tongue (2) and said second tongue (4) are progressively moved apart from each other, thereby extending said stocking fitted on said sleeve, then to a releasing position wherein said lower plate (3) is removed separate from said upper plate (1).

2. A device as claimed in claim 1, wherein said guide system comprises two parallel slide guides (10, 11) which are interconnected at one end by said first plate (1) supporting said first upper tongue (2) and are free at the other end, allowing translational movement of said second lower plate (3) with respect to said first upper plate (1).

3. A device as claimed in claim 2, wherein said movable part can be uncoupled from the rest of the device by sliding said moveable part down out of the free ends of said slide guides (10, 11).

4. A device as claimed in claim 2, wherein said lever means are hollow and they can be lowered to a position where they come over said slide guides, and wherein said lever means and said slide guides are beveled at their cooperating free ends.

5. A device as claimed in claim 1, which comprises lateral handles (8,9) for use for putting said stocking on oneself, which are fixed on each side of said movable part.

6. A device as claimed in claim 5, wherein said handles (8,9) are removable.

7. A device as claimed in claim 5, wherein said handles (8,9) are fixed to said movable part with an adjustable inclination, between a resting position and different operating positions.

8. A device as claimed in claim 5, wherein said handles (8, 9) have a variable length.

9. A device as claimed in claim 1, wherein said first upper tongue (2) and said second lower tongue (4) show a curved section, said upper tongue (2) having a larger radius of curvature and thereby being more flattened than said lower tongue (4), while the latter has a smaller radius of curvature and is downwardly more concave to allow the passage of the heel, said upper tongue (2) and said lower tongue (4) forming a rectilinear ovoid sleeve, when brought close together by sliding said lower plate (3) towards said upper plate (1) along said guide system.

10. A device as claimed in claim 1, wherein said lever means comprise a lever (5) fastened on said fixed part on each side of said device, which is operative to push said movable part away from said fixed part by way of two connecting rods (6,7) bearing on blocking members on said movable part, thereby reducing the effort required to move said lower plate (3) against the elastic reaction of said stocking engaged onto said sleeve in the position wherein said tongues are distant from each other.

11. A device as claimed in claim 10, wherein said lever (5) bears a hook (13) which fastens onto a cooperating bar on said fixed part for locking said device in an open position in which said first upper tongue (2) and said second lower tongue (4) are far enough from each other to allow the passage of the heel in between and in which said upper plate (1) and said lower plate (3) are still connected together through said guide system.

12. A device as claimed in claim 1, wherein said lever means bear two handles for their manipulation, which are fixed on each side of said device.

13. A device as claimed in claim 1, wherein said lever means bear an abutment that prevents them from being raised above an angle of 60 degrees with respect to said guide system.

14. A device as claimed in claim 10, wherein said movable part is mounted on said guide system through two sleeves slidably mounted respectively on two slide guides of said guide system, each being provided with three blocking members aligned with the corresponding slide guide, onto which said connecting rods successively bear during the operation of the device, each of said slide guides comprising three distinct partitions associated each with one of said blocking members, for receiving a pin which is rotatably fixed on one end to the corresponding sleeve and which is free on the other end to fall into one of the partitions, blocking said movable part in its corresponding position on said slide guides, when each of said connecting rods pushes on the corresponding blocking member, thereby performing in three successive steps the extension of said stocking fitted on said sleeve.

15. A device as claimed in claim 14, wherein said partitions have a slanting bottom for receiving said pins.

16. A device as claimed in claim 14, wherein the free ends of said pins are made of a metallic material, and a magnet is fixed in the bottom of each of the partitions which are the farthest away from said fixed part, so that said pins are blocked in said partitions in a position where said stocking is fully extended.

17. A device as claimed in claim 14, wherein said connecting rods and said blocking members have cooperating forms.

18. A device as claimed in claim 1, wherein said upper tongue (2) and said lower tongue (4) can be moved apart from each other by a distance of up to 18 cm, so as to allow the passage of the heel in between without the risk of tearing said stocking.

19. A device as claimed in claim 1, wherein said upper tongue (2) and said lower tongue (4) widen upwards in all planes.

20. A device as claimed in claim 19, wherein said upper tongue (2) and said lower tongue (4) widen by 2 to 3 degrees with respect to their longitudinal axes.

21. A device as claimed in claim 1, wherein said upper tongue (2) and said lower tongue (4) bear each a thicker collar at their upper edge, so that said stocking when fitted onto said sleeve cannot slip from this position.

22. A device a claimed in claim 21, wherein said collar presents an upwardly inclined outer side face.

23. A device as claimed in claim 22, wherein said outer side face is inclined by 5 to 15 degrees with respect to the longitudinal axes of said tongues.

24. A device as claimed in claim 22, wherein said outer side face is inclined by 10 degrees with respect to the longitudinal axes of said tongues.

25. A device as claimed in claim 21, wherein said collar has a planar lower face and round wedges.

26. A device as claimed in claim 2, wherein said slide guides (10, 11) are 20 to 35 cm long, and they are separated from one another by at least 20 cm.

27. A device as claimed in claim 5, wherein said handles (8, 9) have an ergonomic form, and their outer surface bears a series of notches facilitating their handling.

28. A device as claimed in claim 1, which comprises wedges for supporting said device when resting on a support surface.

29. A device for fitting a support stocking on a person, which comprises an upper fixed part comprising a first upper plate (1) having a first upper tongue (2) fastened thereon, and a lower movable part which is slidably mounted on a guide system and comprising a second lower plate (3) having a second lower tongue (4) fastened thereon, said first tongue (2) and said second tongue (3) forming a sleeve for said stocking to be fitted onto when brought close to each other; and a lever (5) for separating said first tongue (2) and said second tongue (4) from each other by sliding on said guide system after said stocking has been introduced by being slid onto said sleeve, so as to enlarge said stocking by distension to allow said person to pass the heel and the leg inside said stocking, which comprises detachable lateral handles (8, 9), and wherein said lower movable part of said device can be removed separate from the rest of the device.

30. A method for fitting an extendible support stocking on a person by means of a device as claimed in claim 1, comprising:

fitting said stocking onto said sleeve formed by said first upper tongue (2) and said second lower tongue (4) brought close to each other.

moving said lower plate (4) apart from said upper plate (2) by way of said lever means, thereby extending said stocking by distension, positioning said device in front of the foot of said person, pulling said device towards said person so as to insert the foot of said person inside said stocking then unroll said stocking around the leg and thereby fit said stocking on, and removing said lower plate (3) separate from said upper plate (1) so as to disengage said device from around the leg.

31. A device for taking off a support stocking worn on a leg of a person, which comprises the lower movable part of the device for fitting a support stocking on a person as claimed in claim 1, comprising said second lower plate (3) and said second lower tongue (4), and lateral handles (8, 9) fixed on each side of said movable part, for pushing an upper part of said stocking toward the foot of said person by means of said second lower tongue (4) slipped into the top of said stocking and passing said stocking over the heel.

32. A device for taking off a support stocking worn on a leg of a person, which comprises an auxiliary element comprising a front tongue of a hemicylindrical form secured to a back strip, the space formed between said strip and the back face of said tongue being larger at the top than at the bottom of said auxiliary element, and a pushing element comprising a pushing tongue of a hemicylindrical form bearing long handles on its upper part, to be introduced by a bottom part m the space formed in said auxiliary element between said front tongue and said back strip, for pushing downwards with the help of said handles said stocking pinched between said front tongue and said pushing tongue.

33. A device as claimed in claim 5, wherein said pushing element comprises the movable part of the device for fitting a support stocking on a person as claimed in claim 5, comprising said second lower plate (3), said second lower tongue (4) and said handles (8, 9).

34. A device as claimed in claim 32, wherein said front tongue and said pushing tongue have complementary forms, so that said front tongue and said pushing tongue can be applied perfectly against on another.

35. A device as claimed in claim 32, wherein the width of the space between said front tongue and said back strip decrases from a value larger, to a value smaller, than the thickness of the bottom part of said pushing tongue, so that said stocking inserted between said front tongue and said back strip can be pinched strongly between said front tongue nd said pushing tongue inserted in said auxiliary element.

36. A device as claimed in claim 35, wherein the bottom part of said pushing tongue is between 8 to 10 mm thick, and the width of the space between said front tongue and said back strip decrases from a value larger than 20 mm at the top of said auxiliary element, to a value between 6 to 8 mm at the bottom.

37. A device as claimed in claim 32, wherein said auxiliary element bears on its upper part, extending upwards from said back strip, a small tongue for the gripping of said element.

38. A device as claimed in claim 37, wherein said small tongue is straight and long enough to abut against a complementary part on said pushing element when said pushing tongue is almost completely inserted between said front tongue and said back strip, avoiding thereby that said pushing tongue penetrates so far between said front tongue and said back strip that it pushes said stocking outside said auxiliary element.

39. A device as claimed in claim 38, wherein said pushing element comprises, a movable part slidably mounted on a guide system and supporting a second lower plate (3) having a second lower tongue (4) secured thereto, wherein and said complementary part is said second lower plate (3).

40. A method for taking off a support stocking worn on a leg of a person, which comprises:

applying between said leg and said stocking an auxiliary element comprising a front tongue of a hemicylindrical form secured to a back strip, the space formed between said strip and the back face of said tongue being larger at a top part than at a bottom part of said element, in such a way that said stocking is inserted between said front tongue and said back strip, introducing a pushing element comprising a pushing tongue of a hemicylindrical form bearing long handles on its upper part, by a bottom part of said pushing tongue, in the space formed in said auxiliary element between said front tongue and said back strip, so as to pinch said stocking between said pushing tongue and said front tongue, and pushing downwards by means of said handles said stocking pinched between said front tongue and said pushing tongue.

* * * * *

UNITED STATES PATENT AND TRADEMARK OFFICE

CERTIFICATE OF CORRECTION

PATENT NO. : 7,216,787 B2
APPLICATION NO. : 11/138668
DATED : May 15, 2007
INVENTOR(S) : Michel Delamare It is certified that error appears in the above-identified patent and that said Letters Patent is hereby corrected as shown below:

On the Title page, Inventor: reads "62 rue de Mondoux, Saint-Cyr-sur-Loire (FR) F-37540" should read -- Saint-Cyr-sur-Loire (FR) --
On the Title page item 30, Foreign Application Priority Data is omitted; should read -- Mar. 28, 2002 (FR) … 02/03881 --
Column 14, line 11, reads "a claimed in" should read -- as claimed in --
Column 14, line 57, reads "stocking then unroll" should read -- stocking, then unrolling --.
Column 14, line 58, reads "thereby fit said" should read -- thereby fitting said --
Column 15, line 24, reads "against on another." should read -- against one another. --
Column 15, line 27, reads "decrases" should read -- decreases --
Column 15, line 27, reads "value larger, to a value smaller," should read -- larger value, to a smaller value, --
Column 15, line 31, reads "nd said" should read -- and said --
Column 15, line 35, reads "decrases" should read -- decreases --
Column 16, line 11, reads "comprises, a movable" should read -- comprises a movable --
Column 16, line 13, reads "wherein and said" should read -- wherein said --

Signed and Sealed this

Tenth Day of June, 2008

JON W. DUDAS
*Director of the United States Patent and Trademark Office*